US009118121B2

(12) United States Patent
Yamamoto et al.

(10) Patent No.: US 9,118,121 B2
(45) Date of Patent: Aug. 25, 2015

(54) BUS BAR

(71) Applicant: Yazaki Corporation, Tokyo (JP)

(72) Inventors: Masaki Yamamoto, Makinohara (JP); Kazutoshi Kurachi, Makinohara (JP); Kei Tomita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/017,608

(22) Filed: Sep. 4, 2013

(65) Prior Publication Data

US 2014/0065894 A1 Mar. 6, 2014

(30) Foreign Application Priority Data

Sep. 5, 2012 (JP) ..... 2012-195110

(51) Int. Cl.

| | |
|---|---|
| ***H01R 4/18*** | (2006.01) |
| ***H01R 11/09*** | (2006.01) |
| ***H01R 11/32*** | (2006.01) |
| ***H01R 13/11*** | (2006.01) |

(52) U.S. Cl.

CPC ..... *H01R 4/18* (2013.01); *H01R 11/09* (2013.01); *H01R 11/32* (2013.01); *H01R 13/112* (2013.01)

(58) Field of Classification Search

CPC ..... H01R 4/18; H01R 4/58; H01R 9/03; H01R 9/226; H01R 9/2458; H01R 12/00; H01R 11/09; H01R 11/32; H01R 13/112

USPC ..... 439/287, 723, 724, 76.1, 76.2, 949, 439/595, 850, 877

See application file for complete search history.

(56) References Cited

U.S. PATENT DOCUMENTS

| | | | | |
|---|---|---|---|---|
| 5,080,615 | A | 1/1992 | Kondo | |
| 7,785,116 | B2 * | 8/2010 | Akahori et al. | 439/76.2 |
| 2012/0298418 | A1 * | 11/2012 | Mochizuki | 174/84 C |
| 2013/0095673 | A1 | 4/2013 | Brandon et al. | |

FOREIGN PATENT DOCUMENTS

| | | | |
|---|---|---|---|
| DE | 29 14 242 | A1 | 10/1979 |
| DE | 10 2004 036 528 | A1 | 3/2005 |
| DE | 10 2005 010 704 | A1 | 9/2006 |
| DE | 10 2011 087 034 | A1 | 5/2012 |
| JP | 2005-019259 | A | 1/2005 |

OTHER PUBLICATIONS

Office Action dated Jun. 4, 2014, issued for the corresponding German patent application No. 10 2013 217 788.7 and English translation thereof.

* cited by examiner

*Primary Examiner* — Amy Cohen Johnson
*Assistant Examiner* — Oscar C Jimenez
(74) *Attorney, Agent, or Firm* — Locke Lord LLP; James E. Armstrong, IV; Brian S. Matross

(57) ABSTRACT

The invention provides a bus bar, which includes an elongated base plate, a plurality of tuning fork-shaped terminal portions and a plurality of plate-shaped terminal portions both extending from one lateral end of the elongated base plate, a terminal-protecting portions being perpendicular to the elongated base plate and extending from both longitudinal ends of the elongated base plate, and an electric wire-crimping portion extending from the other lateral end of the elongated base plate.

2 Claims, 3 Drawing Sheets

BUS BAR

CROSS-REFERENCE TO RELATED APPLICATIONS

This application claims priority from Japanese Patent Application No. 2012-195110 filed on Sep. 5, 2012.

BACKGROUND OF THE INVENTION

1. Field of the Invention

The invention relates to a metallic bus bar which is suitable for a wiring member of an electric junction box.

2. Background of the Invention

FIG. 3 is a perspective view of a conventional bus bar which can be used as a wiring member of an electric junction box. A bus bar 301 can be obtained by, for example, applying a pressure onto a metallic plate, and includes an elongated base plate 302, a plurality of tuning fork-shaped terminal portions 303 and a plurality of plate-shaped terminal portions 304 extending from an lateral end of the elongated base plate 302, a terminal-protecting portions 305 extending from both longitudinal ends of the elongated base plate 302 in the same direction as the plurality of tuning fork-shaped terminal portions 303 extends, and an electric wire-crimping portion 307 extending from the other lateral end of the elongated base plate 302. The terminal-protecting portion 305 is provided with a locking hole 306 with which a lance disposed inside a frame of an electric junction box is brought into locking engagement.

The aforementioned bus bar 301 is received in the frame of an electric junction box while an end portion of the electrical wire being crimped with the electric wire-crimping portion 307. Furthermore, an electric part such as a relay and a fuse is mounted to the frame, thereby allowing a terminal portion of the electric part to electrically connect to the tuning fork-shaped terminal portion 303 and the plate-shaped terminal portion 304. The terminal-protecting portion 305 is not a member or part to be electrically connected to the electric part, and is configured to protect the tuning fork-shaped terminal portion 303 from any deform or breakage when the bus bar 301 colliding against a foreign object until it is received in the frame of the electric junction box.

Prior Art Document

JP 2005-19259 A

However, the aforementioned bus bar 301 has the terminal-protecting portion 305, the tuning fork-shaped portion 303, and plate-shaped terminal portion 304 arranged in the longitudinal direction of the base plate 302. For the above reason, the size of the bus bar 301 in the longitudinal direction of the base plate 302 inevitably increases, thereby needing greater space for receiving the bus bar 301 therein.

SUMMARY OF THE INVENTION

In order to the above problem, one objective of the invention is to provide a bus bar having a terminal-protecting portion for protecting a tuning fork-shaped portion while saving a space for receiving the bus bar.

In one aspect, the invention provides a metallic bus bar, which includes an elongated base plate; a tuning fork-shaped terminal portion extending from an one lateral end of the base plate; and a terminal-protecting portion extending from at least one longitudinal end of the base plate and being perpendicular to the base plate. In this configuration, a longitudinal direction of the terminal-protecting portion corresponds to a longitudinal direction of the tuning fork-shaped terminal portion.

Preferably, the bus bar further includes an electrical wire-crimping portion extending from the other lateral end of the base plate.

DETAILED DESCRIPTION OF THE INVENTION

Figure 1:
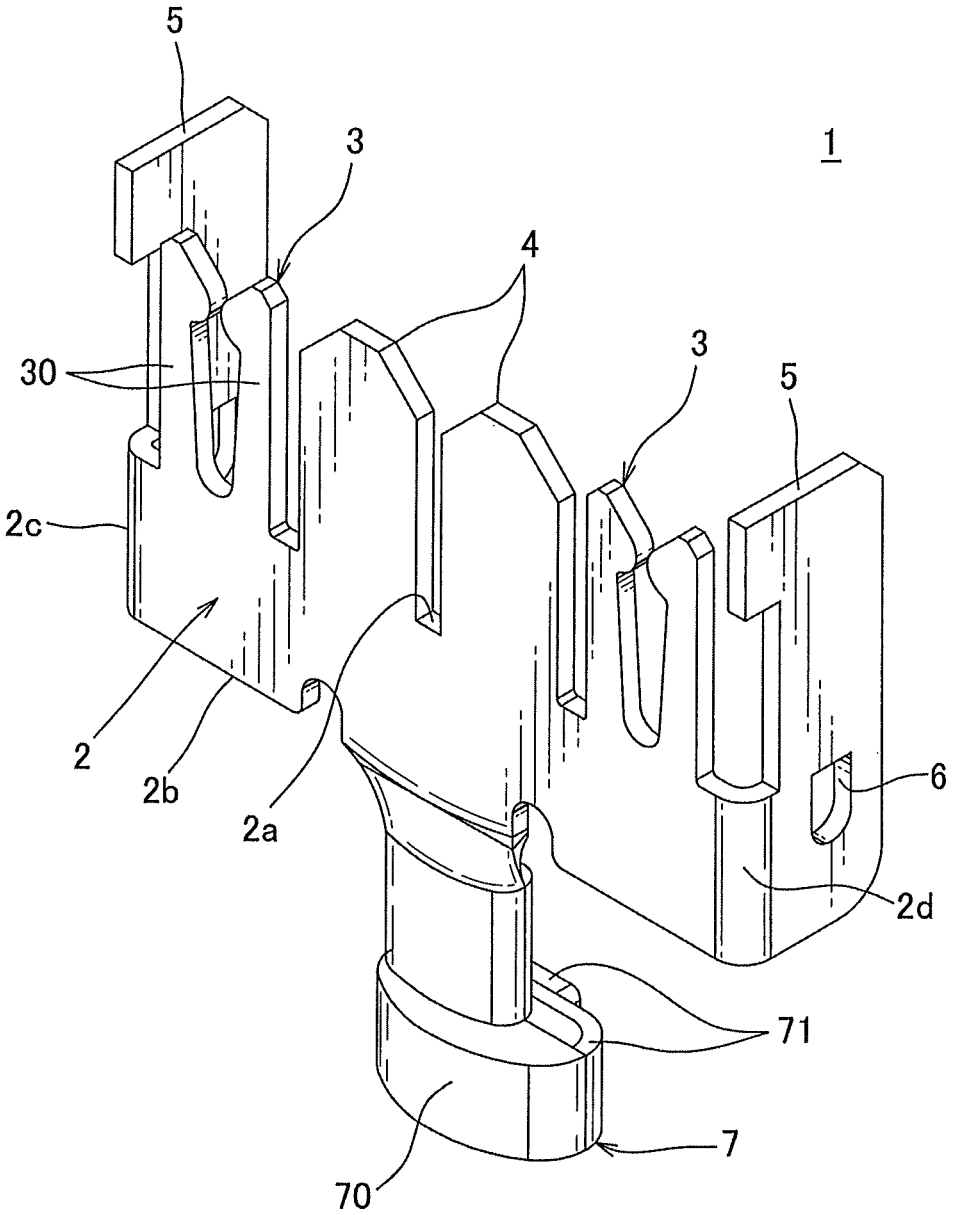
FIG. 1 is a perspective view of an embodiment of a bus bar in accordance with the invention.
Figure 2:
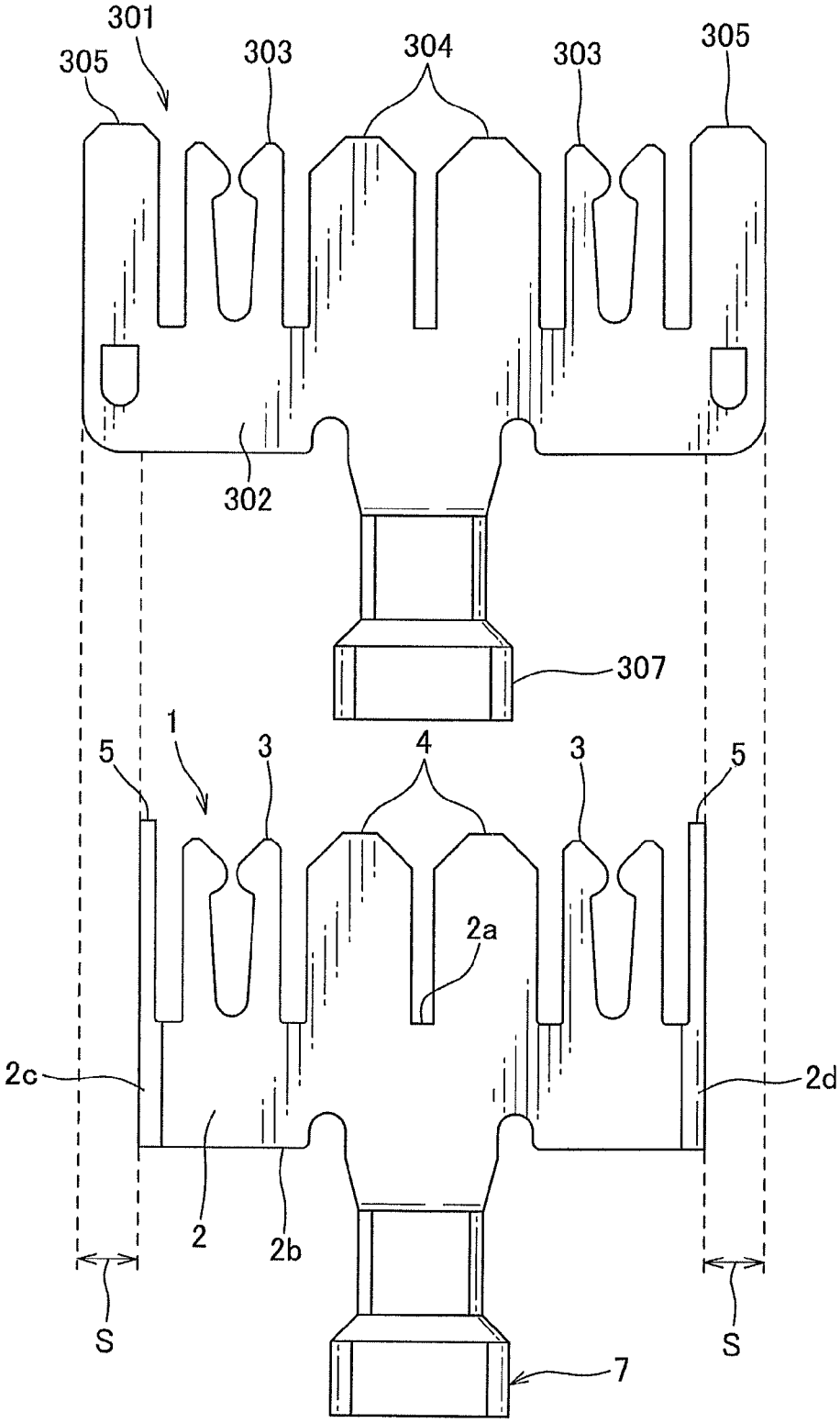
FIG. 2 is provided to explain dimensional difference of a conventional bus bar and the bus bar of FIG. 1.
Figure 3:
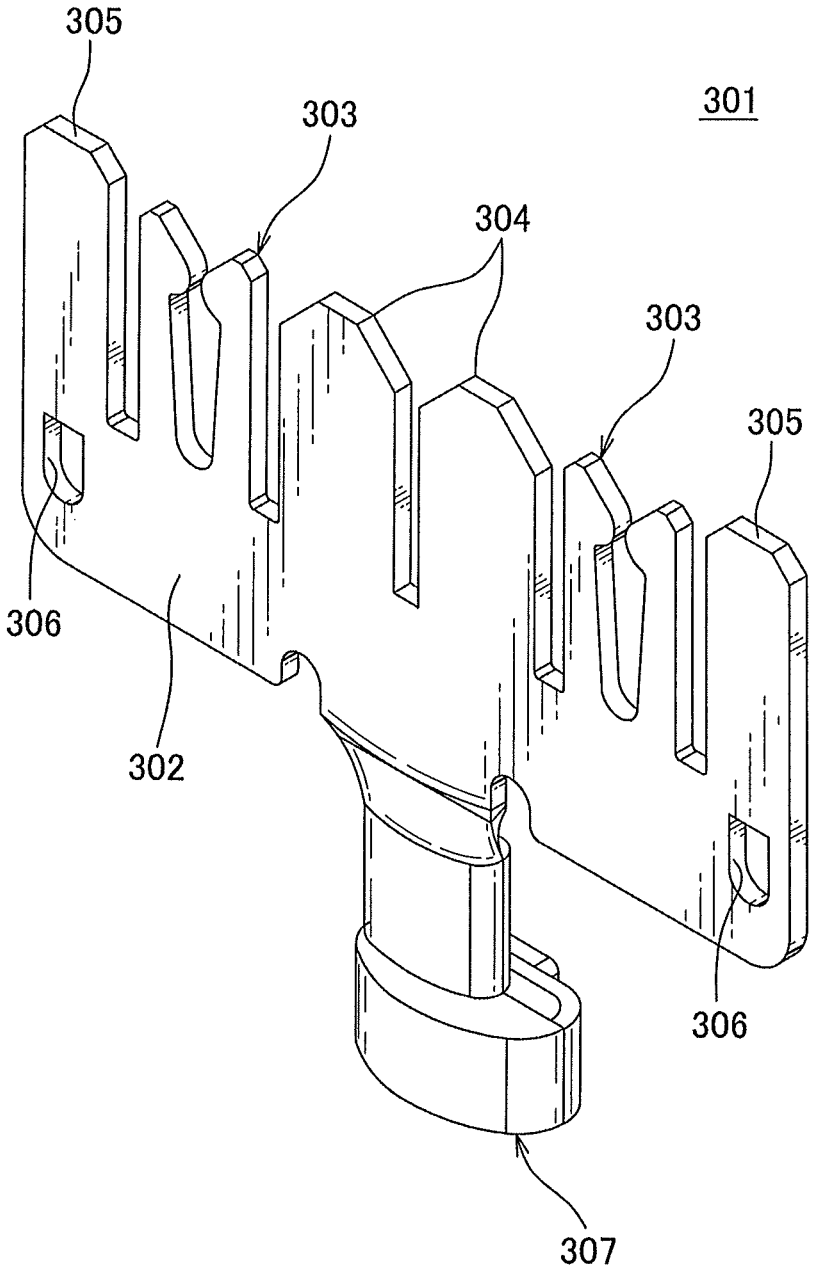
FIG. 3 PRIOR ART
FIG. 3 is a perspective view of a conventional bus bar.

An embodiment of a bus bar in accordance with the invention will be hereinafter explained with reference to FIGS. 1 and 2. A bus bar as shown in FIG. 1 is received in a frame of a vehicle electric junction box, and can be used as a wiring member of the electric junction box. The bus bar can be manufacture by, for example, applying a pressure onto a metallic plate.

The bus bar 1 includes an elongated base plate 2, a plurality of tuning fork-shaped terminal portions 3 and a plurality of plate-shaped terminal portions 4 both extending from one lateral end 2*a* of the elongated base plate 2, a terminal-protecting portions 5 being perpendicular to the elongated base plate 2 and extending from both longitudinal ends 2*c* and 2*d* of the elongated base plate 2, and an electric wire-crimping portion 7 extending from the other lateral end 2*b* of the elongated base plate 2. In this configuration, the longitudinal direction of the terminal-protecting portion 5 corresponds to the longitudinal direction of the tuning fork-shaped terminal portion 3 or the lateral direction of the base plate 2. The longitudinal length of the terminal-protecting portion may be identical to or greater than the sum of the longitudinal length of the tuning fork-shaped terminal portion 3 and the lateral length of the base plate 2.

The tuning fork-shaped terminal portion 3 has a pair of clipping pieces 30 configured to clip or crimp a counterpart terminal portion therebetween. In this regard, the counterpart terminal portion may be a terminal portion of an electric part such as a relay and a fuse to be mounted to the frame of the electric junction box. In one embodiment, two tuning fork-shaped terminal portions 3 are formed adjacent to the plate-shaped terminal portion 4. In other words, two tuning fork-shaped terminal portions 3 are opposite to each other with respect to the plate-shaped terminal portion 4, as shown in FIG. 1.

The plate-shaped terminal portion 4 is provided to electrically connect to electric parts which is mounted to the frame of the electric junction box. In one embodiment, two plate-shaped terminal portions 4 are formed in the middle of the base plate 2. In other words, the two plate-shaped terminal portions 4 are arranged between the two tuning fork-shaped portions 3 in the longitudinal direction of the elongated base plate 2.

The terminal-protecting portion 5 is not a portion electrically connected to any electric or electronic part. The terminal-protecting portion 5 is configured to prevent any deformation or breakage of the tuning fork-shaped terminal portion 3 and the plate-shaped terminal portion 4 when the bus bar 1 collides against any object before being received in the frame of the electric junction box. Furthermore, the terminal-protecting portion 5 is provided with a locking hole 6, which is brought into locking engagement with the lance mounted in the frame of the electric junction box.

Because the tuning fork-shaped terminal portion 3 is generally subject to deformation and breakage, it needs to be protected by the terminal-protecting portion 5. On the other hand, the plate-shaped terminal portion 4 is not subject to deformation and breakage in comparison to the tuning fork-shaped terminal portion 3, it needs not necessarily be protected by the terminal-protecting portion 5. In other words, the embodiment of the bus bar 1 is provided with the terminal-protecting portion 5 due to the presence of the tuning fork-shaped terminal portion 3. For another embodiment of the bus bar in which the plate-shaped terminal portion 4 is provided and the tuning fork-shaped terminal portion 3 is not provided, the terminal-protecting portion 5 may not be needed.

The electric wire-crimping portion 7 is provided with a platform 70 configured to position an end of the electrical wire thereon, and a crimping piece 71 extending from both ends of the platform 70 and configured to crimp a core wire of the electrical wire therewith. Moreover, the electrical wire connected to the electrical wire-crimping portion 7 is a power wire in which great current flows.

When a wiring harness being assembled, the electrical wire-crimping portion 7 of the bus bar 1 is connected to the end portion of the electrical wire, and is transported to a vehicle assembling factory while being connected to the end portion of the electrical wire. For these reasons, the bas bar 1 may collides against a foreign thing during the transportation thereof. However, even if the bus bar 1 collides against the foreign thing, due to the presence of the terminal protecting portion 5 lying outside the tuning fork-shaped portion 3 and the plate-shaped terminal portion 4, the tuning fork-shaped portion 3 and the plate-shaped terminal portion 4 are prevented from directly abutting against or colliding against the foreign thing. As a result, the tuning fork-shaped portion 3 and the plate-shaped terminal portion 4 can be substantially protected from breakage or deformation. During vehicle assembling, the bus bar 1, while being connected to the end of the electrical wire, is received in the frame of the electric junction box. Furthermore, an electric part such as a relay or a fuse is attached or mounted to the frame of the electric junction box, thereby allowing the tuning fork-shaped terminal portion 3 and the plate-shaped terminal portion 4 to be electrically connected to the terminal portion of the electric part.

As described previously, the embodiment of the bus bar 1 is provided with the terminal-protecting portion 5 folded at right angle with respect to the both longitudinal ends 2*c* and 2*d* of the base plate 2. For the reason, in comparison to the conventional bus bar 301 with the terminal-protecting portion 305 which is not folded at right angle with respect to both longitudinal ends of the base plate 302 but is arranged adjacent to the tuning fork-shaped terminal portion 303 in the longitudinal direction of the base plate 302, the overall length (i.e., longitudinal length) of the embodiment of the bus bar 1 can be shortened, as shown in FIG. 2. In other words, the width of the terminal-protecting portion 5 as designated by "S" can be respectively shortened at both longitudinal ends of the bus bar 301. In general, the longitudinal length of the inventive bus bar 1 can be determined by subtracting 2S from the longitudinal length of the conventional bus bar 301. As such, the bus bar 1 can be downsized, thereby reducing the size of the frame of the electric junction box.

In accordance with the aforementioned embodiment, the bus bar 1 is provided with the terminal-protecting portion 5 at both longitudinal ends 2*c*, 2*d* of the base plate 2. However, in another embodiment, the terminal-protecting portion 5 may be formed in either longitudinal end 2*c* or 2*d* of the base plate 2. In accordance with the afore-mentioned embodiment, the bus bar 1 is provided with the electrical wire-crimping portion 7. However, the bus bar 1 may or may not be provided with the electrical wire-crimping portion 7. In other words, the invention is used as a bus bar with no wire-crimping portion, as well as, as a bus bar which is generally transported while being connected to the end of the electrical wire. In the aforementioned embodiment, the bus bar 1 is provided with a plate-shaped terminal portion 4. However, in another embodiment, the bus bar 1 may not be provided with a plate-shaped terminal portion 4.

The present invention has been described in terms of one or more preferred embodiments, and it should be appreciated that many equivalents, alternatives, variations, and modifications, aside from those expressly stated, are possible and within the scope of the invention.

The invention claimed is:

1. A metallic bus bar, comprising: an elongated base plate; a tuning fork-shaped terminal portion extending from one lateral end of the elongated base plate; and a terminal-protecting portion extending from each of two opposed longitudinal ends of the elongated base plate with each terminal protecting portion bent from the same planar surface of the base plate in the same direction so as to extend in a direction perpendicular to the elongated base plate, wherein a longitudinal direction of the bent terminal-protecting portion is orthogonal to a longitudinal direction of the tuning fork-shaped terminal portion.

2. The bus bar as claimed in claim 1, further including an electrical wire-crimping portion extending from the other lateral end of the elongated base plate.

* * * * *